US005351427A

United States Patent [19]

Aigner

[11] Patent Number: 5,351,427

[45] Date of Patent: Oct. 4, 1994

[54] TOY GUNS

[75] Inventor: Gary D. Aigner, Chicago, Ill.

[73] Assignee: Strombecker Corporation, Chicago, Ill.

[21] Appl. No.: 15,618

[22] Filed: Feb. 9, 1993

[51] Int. Cl.[5] ..... F41C 3/06

[52] U.S. Cl. ..... 42/57

[58] Field of Search ..... 42/57, 54; 222/79; 446/473

[56] References Cited

U.S. PATENT DOCUMENTS 1,552,567 9/1925 Reardon ..... 42/57

2,857,699 10/1958 Weimer ..... 42/57

FOREIGN PATENT DOCUMENTS 928571 12/1947 France ..... 42/54

OTHER PUBLICATIONS

Strombecker Corporation, "Tootsietoy", 1991 Catalog Cover Page and p. 27 along with two (2) Photographs showing the internal operational components within the shell of a representative Attack Force toy gun as illustrated on p. 27 of the Catalog.

*Primary Examiner*—Stephen M. Johnson

*Attorney, Agent, or Firm*—Jones, Day, Reavis & Pogue

[57] ABSTRACT

A toy pump action shot gun has an operating mechanism in which individual caps can be detonated in a single shot firing cycle or in a rapid firing sequence under the influence of the reciprocal movement of a pump sleeve interacting with a pushrod assembly to operate a cap detonating structure.

9 Claims, 6 Drawing Sheets

TOY GUNS

BACKGROUND OF THE INVENTION

1. FIELD OF THE INVENTION

The present invention relates to toy guns. More particularly, the invention relates to toy cap guns which operate in a manner simulating the operation of a pump action shot gun having the capability of detonating individual caps from a cap strip in either a single shot firing cycle or in a rapid firing sequence.

2. Description of Related Art

Toy cap guns have been known heretofore and are commercially available which utilize trigger mechanisms exclusively to cause movement of rocker assemblies within the housing of the gun in order to manipulate movable cap firing weights therein for purposes of detonating caps fed on a cap strip from a cap feed clip. Exemplary of such previously available products are the "Attack Force" strip cap pistols and strip cap firing rifles manufactured by Esquire/Nichols.

However, these prior gun constructions have not fully satisfied the consumer's quest for new and improved toy weapons exhibiting unique and distinctive features separately and in combination which operate in an effective and efficient manner. For example, prior toy guns have not incorporated reliable and long-lasting pump action sleeve mechanisms for cocking toy guns into condition for single shot or rapid fire mode of operation simulating the operation of an authentic pump action shot gun construction as is provided herein.

In addition, previously proposed toy guns have relied upon the manipulation of a trigger assembly in order to cause movement of the operative elements within the toy gun housing resulting in the detonation or firing of the caps. Such construction and mode of operation does not enable a rapid fire operation as demonstrated in the present toy guns which is based essentially independently on the operation of a pump sleeve positioned on the barrel portion of the gun without requiring repeated trigger operations.

Summary of the Invention

Therefore, it is an object of the present invention to provide toy shot guns that are capable of functioning in a single shot or a rapid fire mode of operation employing pump action sleeve mechanisms for cocking and firing the toy guns thereby simulating the operation of an authentic pump action shot gun.

It is a further object of the present invention to provide toy guns which simulate the operation of single cycle firing or rapid sequence firing shot guns and which are equipped to operate essentially on the basis of the interaction of a reciprocatingly movable pump sleeve positioned on an external portion of a gun barrel with the firing mechanism in the gun and without relying exclusively on the manipulation of a trigger assembly in order to cause movement of the operative elements within the toy gun housing resulting in the cocking of the toy gun in preparation for detonation or firing of explosive caps.

Another object is to provide a construction wherein the toy shot gun operates in the rapid firing mode without requiring repeated trigger manipulations to enable cap firing resulting in simpler, more efficient and long-lasting operation of the toy gun device.

Thus, the present invention relates to toy guns configured to simulate pump action shot guns. In particular, the present toy guns are constructed having a body including a housing section, a grip assembly section connected to the housing section at a posterior end of the gun body and a barrel assembly section connected to the housing section at an anterior end of the gun body. A pump action sleeve is reciprocatingly mounted on an external surface of the barrel assembly section and moves in a longitudinal direction between the anterior and the posterior ends of the gun body.

A pushrod assembly is mounted in the barrel assembly section and has an end section projecting into the housing section. The pushrod assembly is structured and dimensioned for operative engagement with the movable pump action sleeve so that the pushrod assembly moves reciprocatingly in a longitudinal direction within the gun body in response to the movement of the sleeve.

A rocker arm assembly is pivotally mounted about an axis in the gun housing and is structured and dimensioned to be operatively engaged with an end section of the pushrod assembly which projects into the housing section so that longitudinal reciprocating movement of the pushrod assembly under the influence of the sleeve will cause the rocker arm to pivot about the axis.

In operation, the rocker arm engages a cap firing weight assembly which is reciprocatingly mounted in the housing for longitudinal movement between the anterior and posterior ends of the gun body so that the firing weight is moved in a longitudinal direction between the anterior and posterior ends of the gun body in response to the pivotal movement of the rocker arm. In this manner, the firing weight is moved into a cocked condition capable of being released for movement toward the posterior end of the gun body and into detonating contact with a cap fed into an impact zone for engagement by the firing weight. Accordingly, by the essentially independent action of the pump sleeve, the toy gun is activated or cocked into a condition for firing and cap detonation.

Firing of the gun can then be accomplished by further movement of the rocker arm relative to the firing weight assembly which causes the arm to be disengaged from the weight and, also, by appropriate manipulation of a trigger mechanism provided in the gun housing. For example, in a single shot cycle, if a user of the toy gun depresses a trigger element of the trigger mechanism after the rocker arm is disengaged from the cap firing weight, locking engagement between a trigger catch arrangement on the trigger mechanism and a detent member on the weight is disconnected and the weight is thereby released for impact with the cap and detonation thereof.

Alternatively, the gun can be fired in a rapid fire mode by holding the trigger mechanism in a constantly depressed position and repeatedly operating the pump action sleeve in a reciprocating manner whereby the gun is repetitively cocked and fired solely on the basis of the interaction of the pump sleeve and the firing mechanism within the gun housing.

BRIEF DESCRIPTION OF THE DRAWINGS

The features, objects and advantages of the present invention will be better understood when the following detailed description is read in light of the drawings appended hereto in which like numerals present like elements and in which.

DETAILED DESCRIPTION OF THE PREFERRED EMBODIMENT

Figure 1:
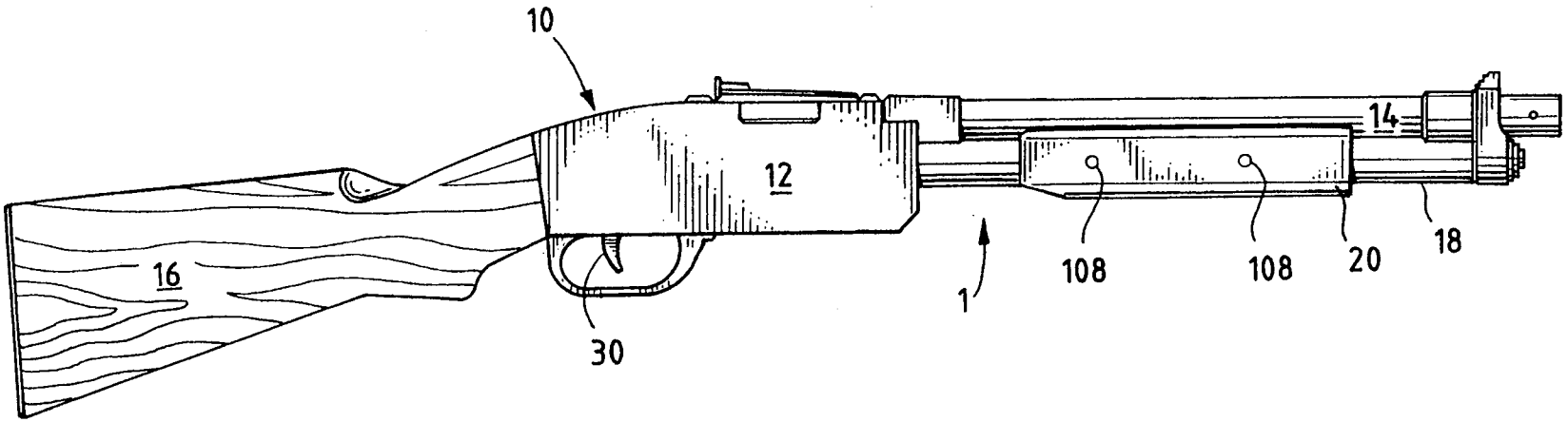
FIG. 1 is a side elevational view showing the external appearance of a toy gun according to the present invention.

As shown in FIGS. 1–6 of the drawings, there is illustrated a preferred embodiment of the toy guns of the present invention, generally designated by the numeral 1. As best illustrated in FIG. 1, the body 10 of toy gun 1 is generally configured in the shape of a shot gun having a main housing 12 with a barrel assembly 14 anteriorly mounted thereto and extending longitudinally forwardly therefrom. A grip assembly 16 is secured to and extends posteriorly from the rear end of the housing 12 in a longitudinal direction essentially opposite the barrel assembly 14.

Barrel assembly 14 includes a cylindrical outer shell member 18 shaped to simulate a barrel arrangement as would be exhibited in the external appearance of a real shot gun construction. A longitudinally extending pump action sleeve assembly 20 is reciprocatingly mounted on the outer circumference of barrel shell 18.

Figure 2:
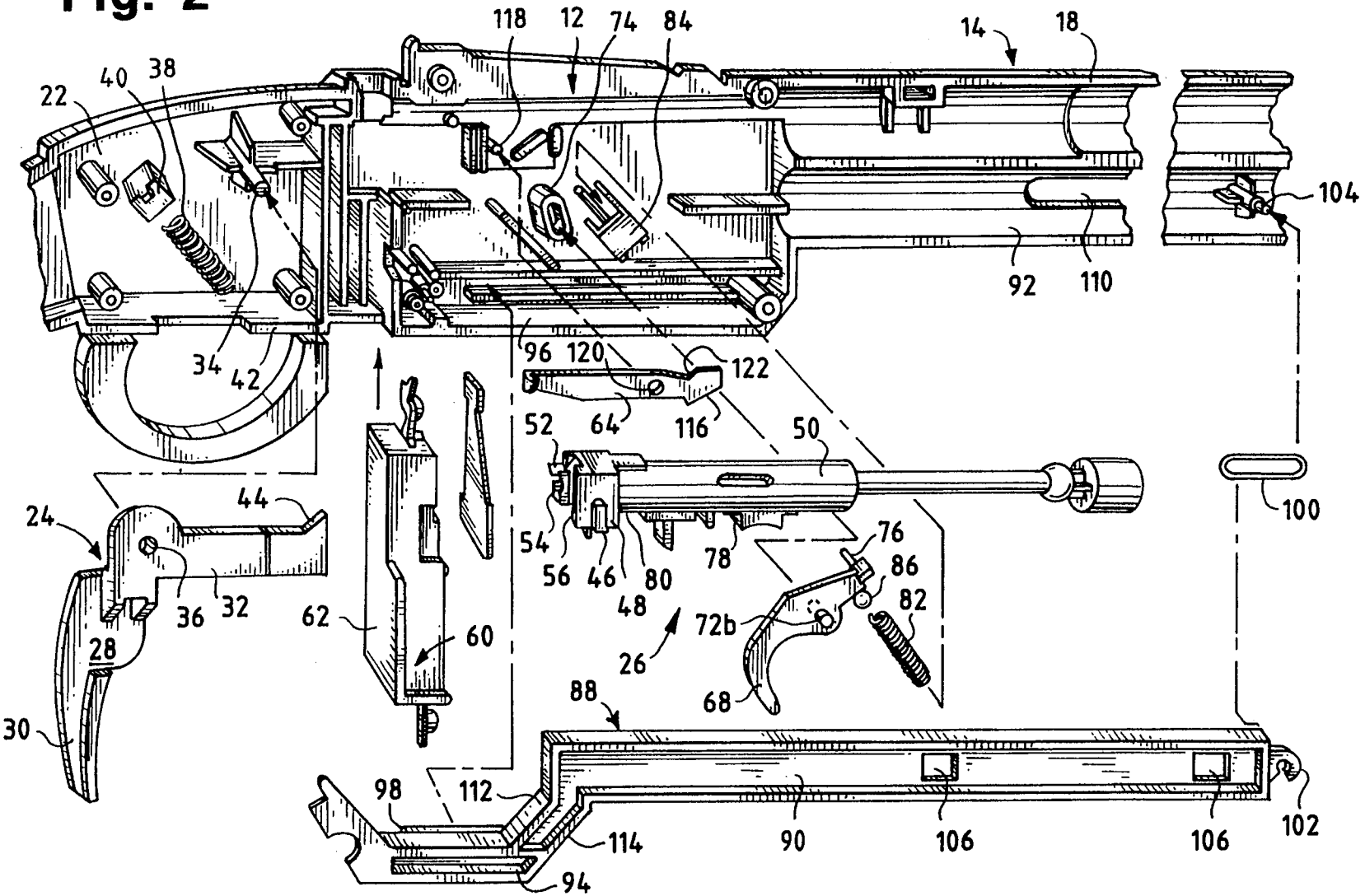
FIG. 2 is a an exploded view showing the individual piece parts housed within the body of the toy gun of FIG. 1.

Referring to FIG. 2, the interior side surface of one half of housing 12 and barrel shell 18 is illustrated (the other side surface which is essentially symmetrical to the illustrated surface is not shown) along with the interior piece parts within the gun body 10. As illustrated, housing 12 is constructed with a hollowed out section 22 to accommodate a trigger assembly 24 and a cap firing assembly 26. The trigger assembly 24 includes an integrally formed, one-piece, generally L-shaped member 28 having two leg segments 30 and 32 which are aligned at essentially right angles to one another with leg segment 30 defining a trigger element and leg segment 32 defining a trigger catch element.

Figure 3:
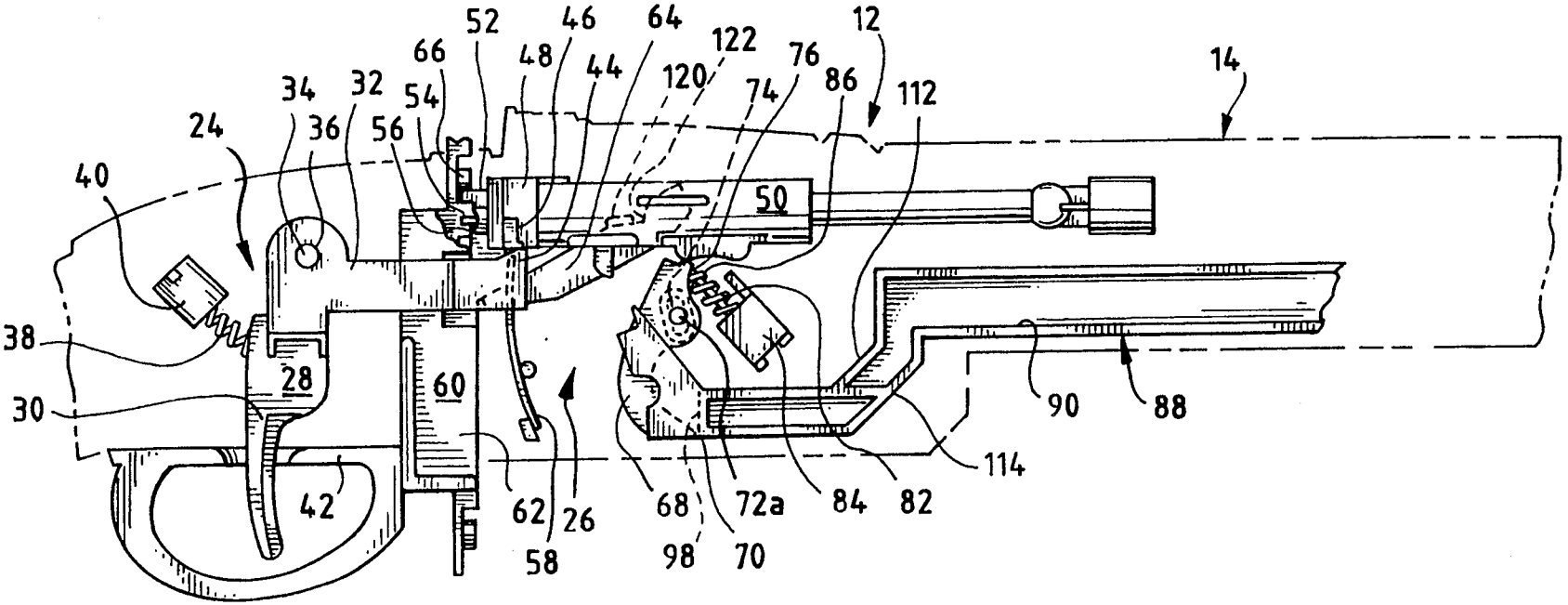
FIG. 3 is a vertical section taken longitudinally through the toy gun of FIG. 1 showing the operative mechanisms in an at rest condition.

L-shaped member 28 is pivotally mounted on a pivot pin 34 formed on housing 12 which extends through aperture 36 formed in member 28 at the intersection of legs 30 and 32. A compression spring 38 is mounted in sleeve 40 on housing 12 and is positioned to engage L-shaped member 28 in a manner such that member 28 is biased in a generally counterclockwise direction about the pivot axis provided by pin 34. Trigger element 30 is thereby aligned, in an at rest condition as best illustrated in FIG. 3, to project essentially vertically downward and outward through casing 42 of housing 12 enabling finger actuation thereof by a user of the toy gun 1.

Also, in an at rest condition and as a result of this biasing action, catch element 32 is positioned to extend anteriorly so that ridge 44 formed on the anterior end of element 22 engages a detent flange 46 projecting laterally sideways from a side surface 48 of a cap firing weight assembly 50 of the cap firing assembly 26 in order to restrain longitudinally rearward movement of weight assembly 50 while the gun 1 is in the at rest condition.

In addition, cap firing weight assembly 50 has a cap detonating pin 52 and a cap cutting element 54 extending rearwardly from the posterior face 56 thereof. The cap firing assembly 26 further includes a leaf spring 58 and a cap feeding mechanism 60 with the spring 58 biasing the weight assembly 50 in the direction of the cap feeding mechanism 60.

Figure 4:
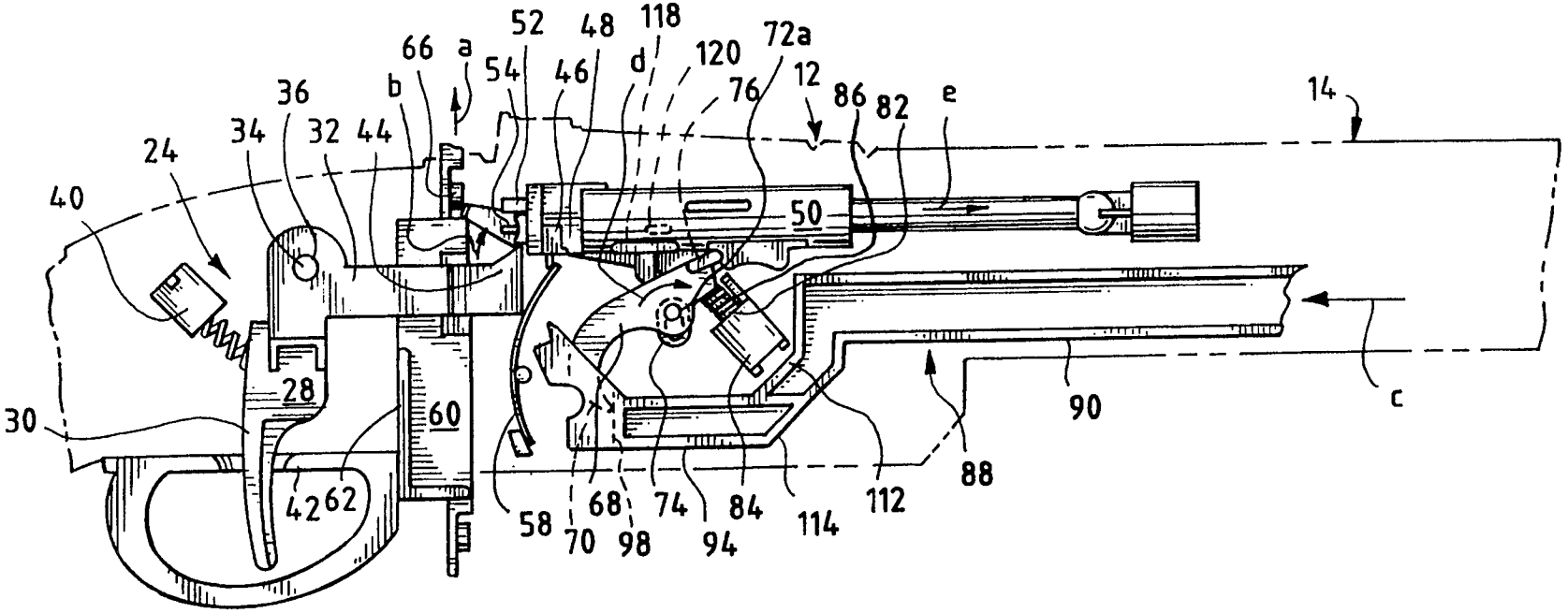
FIG. 4 is a vertical section similar to that of FIG. 3 except that the toy gun is shown with the operative mechanisms in a transient condition between the at rest condition illustrated in FIG. 3 and a fully cocked, ready to fire condition as illustrated in FIG. 5.

The cap feeding mechanism 60 includes a cap feeding clip 62 and a cap advance arm 64 arranged in a manner such that a supply of cap strips 66 is fed vertically upwardly as shown by arrow a in FIG. 4 through the clip 62 under the influence of the pivoting movement of advance arm 64 as shown by arrow b in FIG. 4 to align individual ones of the caps to be engaged by the cap detonating pin 52 and the cap cutting element 54 upon rearward movement of cap firing weight 50.

Cap firing assembly 26 further includes rocker arm 68 which is formed in the general shape of a J-hook having a tip end section 70 and transversely aligned tabs 72*a*, 72*b* extending laterally from opposite side surfaces of arm 68 in a common horizontal plane. Tabs 72*a*, 72*b* ride in axle slots 74 which are aligned symmetrically on opposed facing interior surfaces of housing 12 of gun body 10 (only one such surface and slot 74 being shown). The assembly 26 also includes a transversely aligned pin 76 which is positioned to engage a flange 78 projecting laterally downwardly from the lower surface 80 of firing weight 50.

A compression spring 82 is mounted in sleeve 84 on housing 12 and engages rocker arm 68 at a knobbed section 86 on arm 68. Spring 82 causes arm 68 to pivot in a generally counterclockwise direction about the axis provided by tabs 72*a*, 72*b* in axle slots 74 on the opposed facing interior surfaces of housing 12, respectively. Thus, pin 76 on rocker arm 68 is normally biased, in an at rest condition, upwardly for engagement with flange 78 on firing weight 50 when the rocker arm 68 is rotated in a clockwise direction under the influence of pushrod assembly 88 to cause movement of the weight 50.

Figure 5:
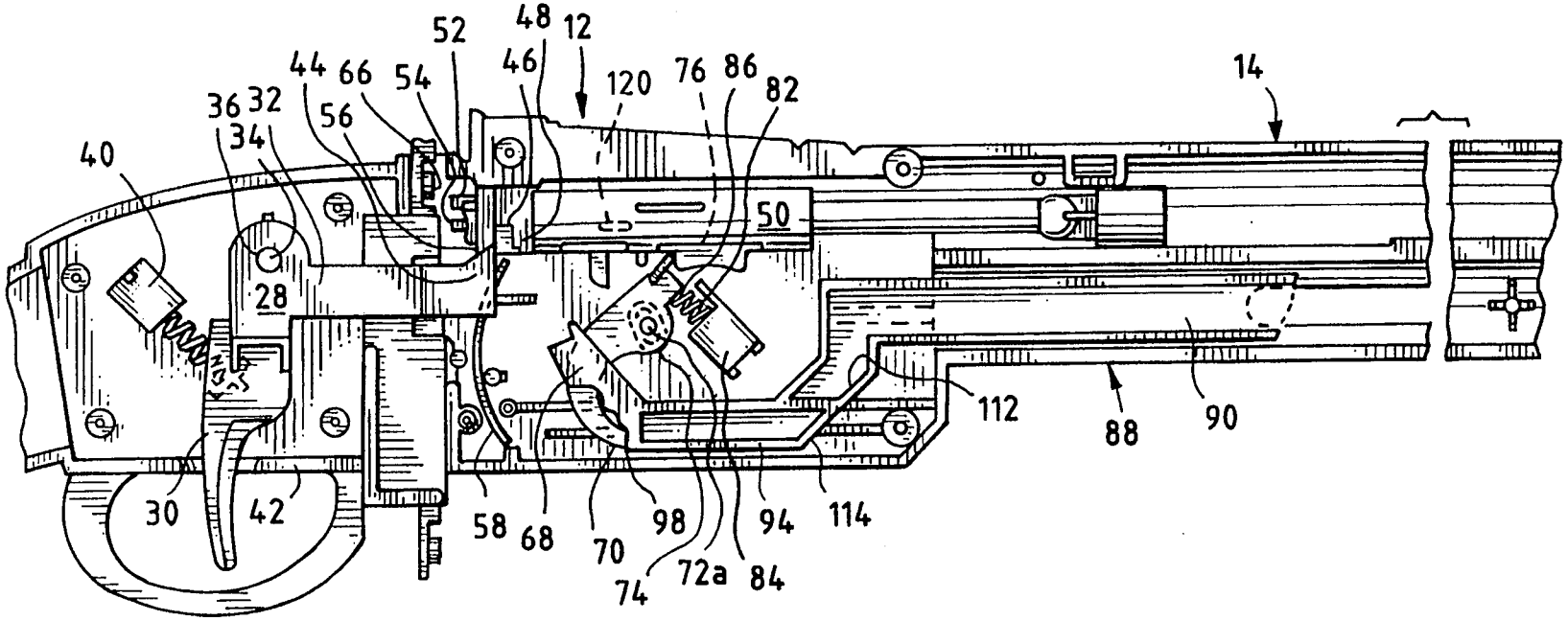
FIG. 5 is a vertical elevational section similar to that shown in FIG. 3 except that the toy gun is shown with the operative mechanisms in a fully cocked, ready to fire condition.

Thus, activation of the operation of cap firing assembly 26 from the at rest condition illustrated in FIG. 3 to the fully cocked, ready to fire condition illustrated in FIG. 5 is accomplished as shown in FIG. 4 by movement in the direction of arrow c of a one piece, integral pushrod assembly 88 aligned to move longitudinally in a reciprocating manner under the influence of the pump sleeve 20 with a forward section 90 positioned in a track 92 formed in the shell 18 of barrel assembly 14 and a rearward section 94 positioned in a track 96 in casing 42 of housing 12. A ledge or engagement surface 98 is formed on the rearward section 94 of the assembly 88. This ledge 98 is positioned to abut against the tip end section 70 of rocker arm 68 upon longitudinally rearward movement of the pushrod 88 toward the posterior of the gun 1.

The assembly 88, in the at rest condition illustrated in FIG. 3, is biased in a forward direction toward the anterior end of gun 1 by an elastic member 100 such as a single or multiple rubber bands interconnected between a hook 102 projecting anteriorly from the front face of the forward section 90 of pushrod 88 and a post 104 formed on the interior surface of shell 18 of barrel 14 as shown in FIG. 2. In addition, the forward section 90 of pushrod assembly 88 is provided with slots 106 which are positioned to accept tabs 108 projecting inwardly from the interior side surfaces on pump sleeve 20 through apertures 110 formed in the shell 18 of each half of barrel 14. The tabs 108 are structured and aligned to cooperatively interconnect within the barrel 14 by any appropriate means such as a screw interlock (not shown). In this manner, the pump action sleeve 20 is detachably and operatively engaged with the pushrod assembly 88.

As illustrated, the pushrod assembly 88 is bent at a position 112 intermediate the forward and rearward sections 90 and 94, respectively, of the assembly 88 in order to conform the rod 88 to the shape of the casing 42 of housing 12 and, also, in order to form an abutment ledge 114 which impacts against the interior of the casing 42 of housing 12 in order to provide a forward stop restricting the extent of the longitudinally forward movement of the rod 88.

The single shot cycle sequence of operation of the present toy shot gun is as follows:

Initially, pump sleeve 20 is moved in a rearward direction toward the posterior end of the toy gun 1 which causes the push rod assembly 88 to move in a longitudinally rearward direction as shown by arrow c in FIG. 4 under the influence of the pump sleeve 20. As the push rod 88 moves rearwardly, ledge 98 engages tip end 70 of rocker arm 68 and causes the rocker arm to pivot in a clockwise direction (as shown by arrow d in FIG. 4) about the axis provided by tabs 72*a*, 72*b* seated within axle slots 74. The clockwise movement of rocker arm 68 causes pin 76 on rocker arm 68 to engage flange 78 on firing weight assembly 50 and to move the firing weight assembly 50 in a longitudinally forward direction (shown by arrow e in FIG. 4) towards the anterior end of the gun 1.

As the rocker arm 68 moves in the counterclockwise direction prior to moving engagement with flange 78, pin 76 first engages a cam surface 116 on cap advance arm 64 and causes the arm 64 to pivot downwardly, to a position illustrated in FIG. 3, about an axis formed by pivot pin 118 projecting through aperture 120 formed in cap advance arm 64. This movement of the cap advance arm prior to initial movement of the cap firing weight assembly 50 enables the cap advance arm 64 to contact a single one of the caps in the cap strip 66 and then, as the firing weight 50 begins to move longitudinally forwardly under the influence of rocker arm 68, a tab 120 on the rear face of firing weight 50 engages a cam surface 122 on the top of the cap advance arm 68 causing the cap advance arm 68 to pivot upwardly about pivot pin 110 as illustrated by arrow b in FIG. 4 causing the cap strip 66 to move upwardly (arrow a in FIG. 4) so that an individual cap is positioned for engagement by the cap detonating pin 52 and the cap cutting element 54 upon rearward firing motion of the cap firing weight 50 as illustrated by arrow f in FIG. 6.

Figure 6:
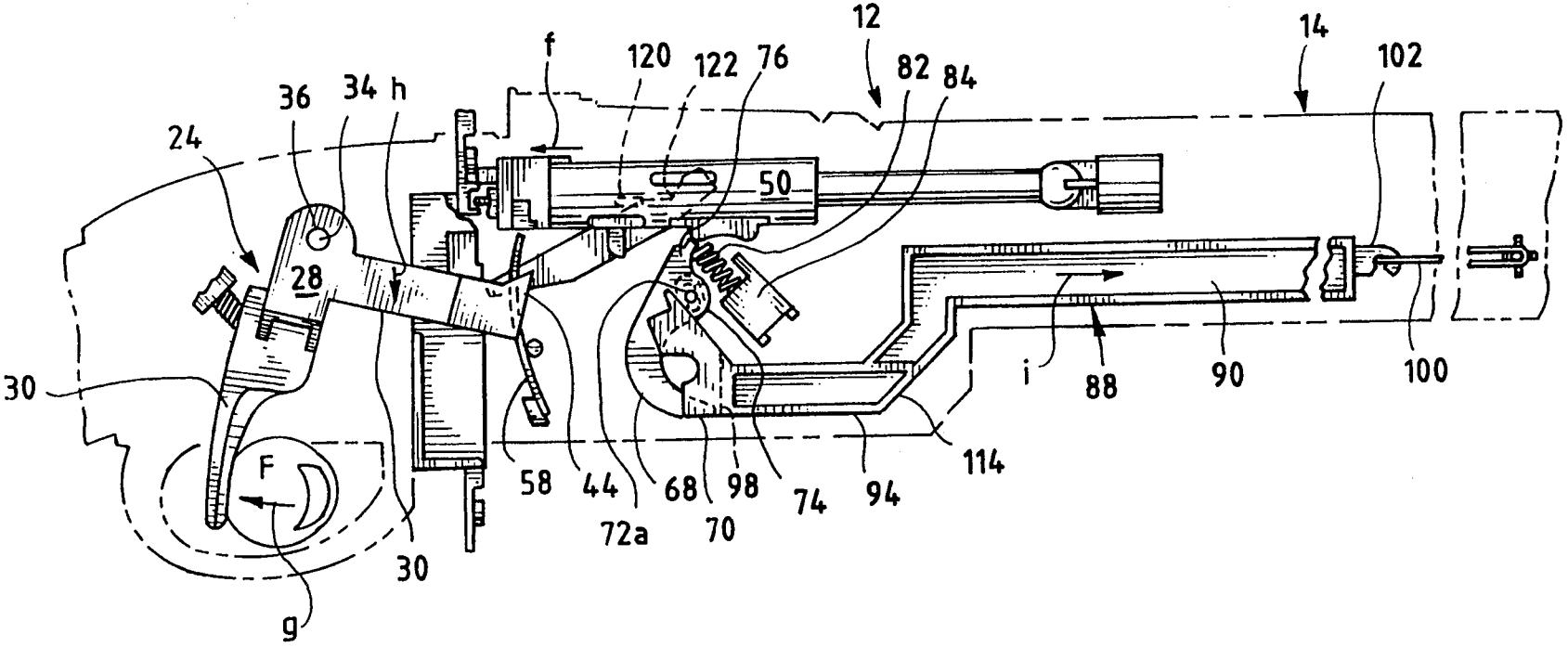
FIG. 6 is a vertical section similar to that shown in FIG. 3 except that the toy gun is shown with the operative mechanisms in a transient condition from the fully cocked condition illustrated in FIG. 5 to an explosive impact condition in which a cap is fired or detonated.

The final stage in cocking the mechanism of the toy gun 1 for placing it in condition to fire and detonate a cap, comprises completing the counterclockwise pivoting of rocker arm 68 under the influence of push rod assembly 88 until the firing weight 50 is in its farthest forward position as shown in FIG. 6 at which time pivot tabs 72*a*, 72*b* in axle slots 74 cease pivoting motion and act as cam following element within slots 74 moving downwardly within the axle slots 74 to the position illustrated in FIG. 6. This movement of tabs 72*a*, 72*b* causes the pin 76 on rocker arm 68 to disengage from flange 78 on firing weight assembly 50 enabling the detonating pin 52 on firing weight assembly 50 to move in a longitudinally rearward direction (arrow f) under the influence of leaf spring 58 and into detonating engagement with the cap.

Thus, as best illustrated in FIG. 6, upon actuation of trigger assembly 24 by a finger F of a user of the gun 1 depressing trigger leg 30 of L-shaped member 28 rearwardly in the direction of arrow g, the assembly 24 pivots about pivot pin 34 in the direction of arrow h releasing the engagement of ridge 44 on trigger catch 32 from engagement with detent flange 46 on firing weight assembly 50 enabling the firing weight to contact and detonate the cap while severing it from the remainder of the cap strip 66 by operation of cap cutting element 54. Thereafter, the pushrod assembly moves back in the reciprocal direction shown by arrow i in FIG. 6 under the bias of elastic element 100 and all of the other operative elements in the gun 1 return to the at rest condition as illustrated in FIG. 3.

The foregoing description has been directed to a single shot cycle of operation. However, it should be noted that for rapid fire sequence of action, the trigger assembly 24 is maintained in a fully depressed rearward condition so that catch 32 is not in engagement with the flange 46 on the firing weight 50 at any time and by continuous reciprocating movement of the pump sleeve 20, the push rod 88 interacts with the rocker arm repetitively resulting in repetitive cocking motion of the firing weight 50 with the accompanying release and firing movement under the influence of leaf spring 58. This action enables the rapid fire operation of the gun in an essentially constant firing sequence.

The foregoing specification describes only the embodiments of the invention shown and/or described. Other embodiments may be articulated as well. The terms and expressions used, therefore, serve only to describe the invention by example and not to limit the invention. It is expected that others will perceive differences which, while different from the foregoing, do not depart from the scope of the invention herein described and claimed. In particular, any of the specific constructional elements described may be replaced by any element having equivalent function.

I claim:

1. A toy gun comprising:

a body including a housing section, a grip assembly section connected to said housing section at a posterior end of said gun body and a barrel assembly section connected to said housing section at an anterior end of said gun body;

a sleeve means reciprocatingly mounted on an external surface of said barrel assembly section for movement in a longitudinal direction between the anterior and the posterior ends of said gun body;

a pushrod assembly mounted in said barrel assembly section and having an end section projecting into said housing section, said pushrod assembly being structured and dimensioned for operative engagement with said movable sleeve means in a manner such that said pushrod assembly moves reciprocatingly in a longitudinal direction between the anterior and posterior ends of said gun body responsive to the movement of said sleeve means;

a rocker arm means pivotally mounted about an axis in said housing, said arm means being structured and dimensioned for operative engagement with said end section of said pushrod assembly projecting into said housing section in a manner such that longitudinal reciprocating movement of said pushrod assembly under the influence of said sleeve means causes said rocker arm to pivot about said axis;

a trigger means pivotally mounted on said housing comprising a trigger element projecting from said housing for actuation by a user of said gun and a trigger catch element operatively interconnected with said trigger element, said catch element being normally biased into engagement with a cap firing weight and being disengageable from said cap firing weight in response to actuation of said trigger element enabling said firing weight to be released for movement into detonating contact with a cap, said trigger means comprises an integrally formed, one-piece, essentially L-shaped member having two leg segments aligned at essentially right angles to one another with one leg segment forming said trigger element and the other leg segment forming said trigger catch element.

2. A toy gun according to claim 1 wherein said L-shaped trigger means is pivotally mounted on a pivot pin formed on said housing and said L-shaped member is biased in a generally counterclockwise direction about a pivot axis provided by said pivot pin to align said trigger element to project essentially vertically downward and outward through said housing and to position said catch element in engagement with said cap firing weight.

3. A toy gun according to claim 2 wherein a ridge is formed on said catch element which engages a detent flange projecting from a surface of said cap firing weight to restrain longitudinal movement of cap firing weight assembly while the gun is in an at rest condition.

4. A toy gun according to claim 3 wherein said pushrod assembly is a one piece, integral member having a first section and a second section with a ledge being formed on said first section to provide an engagement surface against which said rocker arm abuts to provide said operative engagement between said pushrod assembly and said rocker arm whereby longitudinal movement of said pushrod assembly causes said pivotal movement of said rocker arm.

5. A toy gun according to claim 1 including a cap firing weight assembly reciprocatingly mounted in said housing for longitudinal movement between the anterior and posterior ends of said gun body, said cap firing weight assembly being structured and dimensioned for operative engagement with said rocker arm means in a manner such that said cap firing weight assembly moves in a longitudinal direction between the anterior and posterior ends of said gun body in response to pivotal movement of said rocker arm whereby said cap firing weight assembly is positioned in a cocked condition capable of being released for detonating a cap.

6. A toy gun comprising:

a body including a housing section, a grip assembly section connected to said housing section at a posterior end of said gun body and a barrel assembly section connected to said housing section at an anterior end of said gun body;

a sleeve means reciprocatingly mounted on an external surface of said barrel assembly section for movement in a longitudinal direction between the anterior and the posterior ends of said gun body;

a pushrod assembly mounted in said barrel assembly section and having an end section projecting into said housing section, said pushrod assembly being structured and dimensioned for operative engagement with said movable sleeve means in a manner such that said pushrod assembly moves reciprocatingly in a longitudinal direction between the anterior and posterior ends of said gun body responsive to the movement of said sleeve means;

a rocker arm means pivotally mounted about an axis in said housing, said arm means being structured and dimensioned for operative engagement with said end section of said pushrod assembly projecting into said housing section in a manner such that longitudinal reciprocating movement of said pushrod assembly under the influence of said sleeve means causes said rocker arm to pivot about said axis;

said pushrod assembly is a one piece, integral member having a first section and a second section with a ledge being formed on said first section to provide an engagement surface against which said rocker arm abuts to provide said operative engagement between said pushrod assembly and said rocker arm whereby longitudinal movement of said pushrod assembly causes said pivotal movement of said rocker arm; and said pushrod assembly is bent at a position intermediate said first and second sections to form an abutment ledge which impacts against the interior of said housing to provide a stop means restricting the extent of movement of said pushrod assembly.

7. A toy gun according to claim 6 including a cap firing weight assembly reciprocatingly mounted in said housing for longitudinal movement between the anterior and posterior ends of said gun body, said cap firing weight assembly being structured and dimensioned for operative engagement with said rocker arm means in a manner such that said cap firing weight assembly moves in a longitudinal direction between the anterior and posterior ends of said gun body in response to pivotal movement of said rocker arm whereby said cap firing weight assembly is positioned in a cocked condition capable of being released for detonating a cap.

8. A toy gun according to claim 7 including trigger means pivotally mounted on said housing comprising a trigger element projecting from said housing for actuation by a user of said gun and a trigger catch element operatively interconnected with said trigger element, said catch element being normally biased into engagement with said cap firing weight assembly and being disengageable from said cap firing weight assembly in response to actuation of said trigger element enabling said cap firing weight assembly to be released for movement into detonating contact with said cap.

9. A toy gun according to claim 8 wherein said trigger means comprises an integrally formed, one-piece, essentially L-shaped member having two leg segments aligned at essentially right angles to one another with one leg segment forming said trigger element and the other leg segment forming said trigger catch element.

* * * * *